US005168576A

United States Patent [19]

Krent et al.

[11] Patent Number: 5,168,576

[45] Date of Patent: Dec. 8, 1992

[54] BODY PROTECTIVE DEVICE

[76] Inventors: Edward D. Krent, 207 Hampton Rd., Sharon, Mass. 02067; Nicholas B. Paffett, 806 Tucker La., Hingham, Mass. 02043

[21] Appl. No.: 592,188

[22] Filed: Oct. 3, 1990

[51] Int. Cl.[5] ..... A41D 13/00

[52] U.S. Cl. ..... 2/2; 2/267

[58] Field of Search ..... 2/2, 16, 22, 24, 267, 2/268, 243 R, 243 A, DIG. 1, 44, 45, 267; 128/89 R, 156, 157

[56] References Cited

U.S. PATENT DOCUMENTS

| | | | |
|---|---|---|---|
| 1,970,130 | 8/1934 | Dickenson | 2/2 |
| 2,440,664 | 4/1948 | Freedman | 2/42 |
| 2,553,612 | 5/1951 | Taylor | 2/22 |
| 2,976,539 | 3/1961 | Brown, Jr. | 2/2 |
| 3,125,762 | 3/1964 | Glahe | 2/2 |
| 3,208,080 | 9/1965 | Hirsch | 2/3 |
| 3,248,738 | 5/1966 | Morgan | 2/2 |
| 3,348,236 | 10/1967 | Copeland | 2/2 |
| 3,945,042 | 3/1976 | Lobo | 2/2 |
| 4,272,847 | 6/1981 | Buhler | 2/2 |
| 4,292,263 | 9/1981 | Hanrahan et al. | 2/23 |
| 4,307,471 | 12/1981 | Lovell | 2/411 |
| 4,325,148 | 4/1982 | Livernois | 2/2 |
| 4,422,183 | 12/1983 | Landi et al. | 2/2 |
| 4,453,271 | 6/1984 | Donzis | 2/2 |
| 4,507,801 | 4/1985 | Kavangh et al. | 2/2 |
| 4,538,301 | 9/1985 | Sawatski et al. | 2/2 |
| 4,580,408 | 4/1986 | Stuebner | 2/DIG. 1 |
| 4,642,814 | 2/1987 | Godfrey | 2/413 |
| 4,677,698 | 7/1987 | Angas | 2/16 |
| 4,680,813 | 7/1987 | Glaeser | 2/DIG. 1 |
| 4,685,155 | 8/1987 | Fingerhut et al. | 2/DIG. 1 |
| 4,688,269 | 8/1987 | Maeshima | 2/2 |
| 4,700,407 | 10/1987 | Mattila | 2/2 |
| 4,788,972 | 12/1988 | DeBusk | 2/243 A |
| 4,810,559 | 3/1989 | Fortier et al. | 2/2 |
| 4,825,476 | 5/1989 | Andrews | 2/421 |
| 4,884,295 | 12/1989 | Cox | 2/2 |
| 4,926,503 | 5/1990 | Wingo | 2/2 |
| 4,982,447 | 1/1991 | Henson | 2/2 |
| 5,007,108 | 4/1991 | Loberge et al. | 2/2 |

FOREIGN PATENT DOCUMENTS

| | | | |
|---|---|---|---|
| 3401111 | 7/1985 | Fed. Rep. of Germany | 2/2 |

*Primary Examiner*—Werner H. Schroeder
*Assistant Examiner*—Amy Brooke Vanatta
*Attorney, Agent, or Firm*—Wolf, Greenfield & Sacks

[57] ABSTRACT

Protective body padding comprising a plurality of foam modules interconnected by a membrane. The foam modules and/or membrane have a plurality of perforations extending completely therethrough and a matrix of interconnecting air channels designed to provide breathability and cooling capacity to allow venting of heat and moisture from the skin. In a preferred embodiment, the foam in the modules is of a variable density, wherein the density of foam closest to the skin is less than the density of foam immediately above. For sports use, the modules can be positioned between the upper and lower resilient layers in a variety of positions to articulate with vulnerable body parts. Moreover, the foam can be colored or provided with an array of tradenames, trademarks and/or logos to enhance the aesthetic and fashion qualities thereof.

29 Claims, 13 Drawing Sheets

BODY PROTECTIVE DEVICE

FIELD OF THE INVENTION

This invention relates generally to the field of protective body padding and, more specifically, to articulated, breathable, modular padding with a stretchable membrane.

BACKGROUND OF THE INVENTION

For the past several decades, the popularity of outdoor sports has increased participation in activities that require protective body padding. Especially among 5–15 year olds, sports activities such as on-road and off-road biking, roller blading, roller skating, skateboarding, boogie boarding, surfing, and windsurfing, and the injuries attendant thereto, have revealed that these sports do indeed involve falls and collisions and that a variety of serious injuries including bumps and abrasions can result from such accidents. Furthermore, more conventional sports such as baseball, basketball, football, hockey, soccer and the like also require body protective devices.

Nevertheless, many existing body protection devices cannot be articulated in response to movement of body joints to reflect the patterns of motion of the various sports. Moreover, conventional protective body devices do not permit the escape of heat or moisture from the skin. As a result, the wearer becomes uncomfortably warm, and the padding in the devices becomes saturated with sweat. This becomes especially important when it is appreciated that over 40% of the body is covered by protective padding during contact sports such as football.

In addition, many young people will not wear conventional body protective devices because such padding is not fashionable, is unattractive or is uncomfortable.

SUMMARY OF THE INVENTION

It is an object of this invention to provide a body protection device that permits the escape of heat and moisture from the skin.

It is a further object of this invention to provide articulated body padding that can be adapted to protect a wide variety of vulnerable body parts.

It is another further object of the invention to provide articulated body padding that is fashionable and that can be easily made in different colors and shapes as well as easily adapted to receive various logos, trademarks, tradenames and decorations.

In accordance with the foregoing objects, the present invention is related to body padding comprising a plurality of articulated breathable molded foam modules. Specifically, the modules of the body padding of this invention include impact resistant foam having an upper surface and a lower surface embedded between an upper and lower layer of resilient, breathable fabric. The padding modules are connected to each other through thinner stretchable areas called intermodular membranes that are not necessarily designed for impact absorption but which permit articulation and which may allow heat and moisture to escape from the skin.

In a preferred embodiment, each module or the membranes or both the modules and membrane has a plurality of air passages extending completely through from the upper surface to the lower surface. The lower entrance of each of the passages communicates with a recessed air chamber. In preferred embodiments, additional air channels connect adjacent recessed air chambers so that, when the body padding is worn, heat, moisture, salt, gases, and the like released from the skin are removed by the circulation of air through the air channels and out through the air passages.

The lower breathable fabric layer may be a cotton-lycra stretch material and the upper breathable fabric layer may be a durable bonded stretch fabric such as nylon. Preferably, the intermodular membranes have no foam but, instead, have a layer of closed cell neoprene that is sandwiched between the lower layer of cotton-lycra and the upper layer of durable bonded stretch fabric.

In a preferred embodiment of the invention, the foam that makes up the padding modules is formed of a plurality of layers, such as three. The top layer typically is a closed-cell, high density foam, the middle layer is a closed-cell, medium density foam and the layer closest to the skin is a low-density, open cell foam. The layer of open cell foam is immediately adjacent to the cotton lycra stretch fabric layer. This open cell foam cushions and conforms to the body. The second layer of medium density foam closed cell immediately above the open cell foam helps absorb impact. The high density, closed cell foam layer is designed to distribute point impacts to a larger area and to protect the layers below from impact damage.

In another embodiment, the modules are connected by tapered sections and these tapered, thinner sections have a plurality of air passages extending completely therethrough. The lower entrance of each of the passages communicates with air channels which connect adjacent air passages and which space the padding from the skin, thus promoting ventilation of the skin.

In yet another embodiment of the invention, high density plastic or resin is applied to the upper layer of bonded stretch fabric at strategic locations to provide a hard surface for wear resistance or for enhancing the ability of the pads to slide over and not grip a playing surface, while still maintaining the breathability and flexibility of the fabric and pads. These high density plastic or resin locations may be provided with a light reflecting material for increased nighttime visibility. Plastic can be applied in various patterns for both graphic and protective effect. In further embodiments of the invention, the upper fabric layer of durable bonded stretch material can be an open-weave nylon or a mesh covering.

The protective body armor of this invention can be adapted to fit many body parts including knees, ankles, wrists, hands, elbows, head, shoulders, chest, back and shins.

DETAILED DESCRIPTION OF THE DRAWINGS

The objects, advantages and features of the invention will be more clearly appreciated from the following detailed description of the invention when taken in conjunction with the drawings in which.

DETAILED DESCRIPTION OF THE INVENTION

Figure 1:
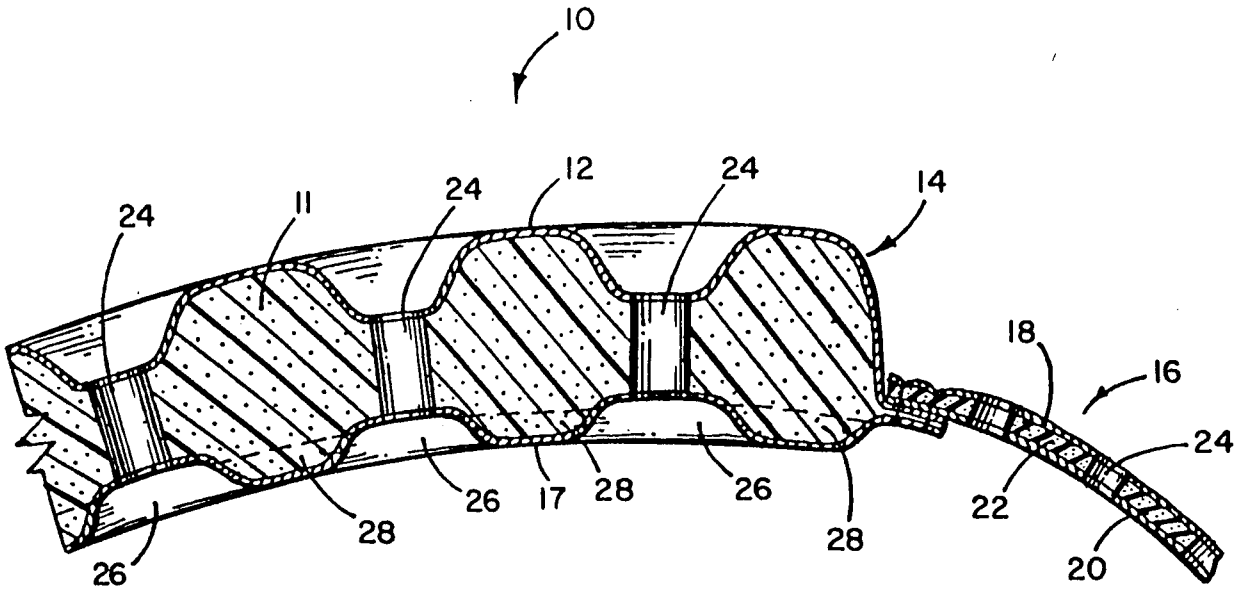
FIG. 1 is a cross-sectional view of padding employing the present invention.

With reference now to the drawings, and more particularly to FIG. 1 thereof, the body padding of this invention will be described. Body padding 10 broadly includes a plurality of thicker, padded sections, referred to as modules 14, which are interconnected by thinner portions which are referred to as intermodular membranes 16. Modules 14 are designed to protect the body by absorbing blows thereto and to protect the skin from abrasions. Intermodular membranes are intended to resist abrasions, and to interconnect modules 14 so as to permit articulation of padding 10 in response to body movement. Typically, an extension of membrane 16 tightly surrounds a portion of the body to elastically retain padding 10 in place on the body portion, although padding 10 may be retained in a desired location on the body by other known means.

Each module 14 is formed of an interior material 11 sandwiched between an upper layer 12 and a lower layer 17. Material 11 typically is a molded foam, while layers 12 and 17 typically are formed of a resilient or elastic material. Intermodular membrane 16 comprises an upper layer 18 and a lower layer 20 having a layer 22 sandwiched therebetween. Layers 18 and 20 may be formed of the same material as layers 12 and 17 and may comprise any flexible or elastic material. Layer 22 typically is flexible, and can stretch along with layers 18 and 20 to allow padding 10 to be placed in position on the body or removed therefrom. Layers 17 and 20 typically are placed adjacent the skin when padding 10 is in use.

Both modules 14 and membranes 16 are traversed by a plurality of air passages 24 which provide gaseous communication between an upper surface adjacent layers 12 and 18, and a lower surface adjacent layers 17 and 20. Air passages 24 permit the escape of moisture, heat, salt, gases and the like from the skin's surface to the external environment. Air passages 24 may be die cut into the foam material 11 prior to assembly, or after assembly.

Figure 3:
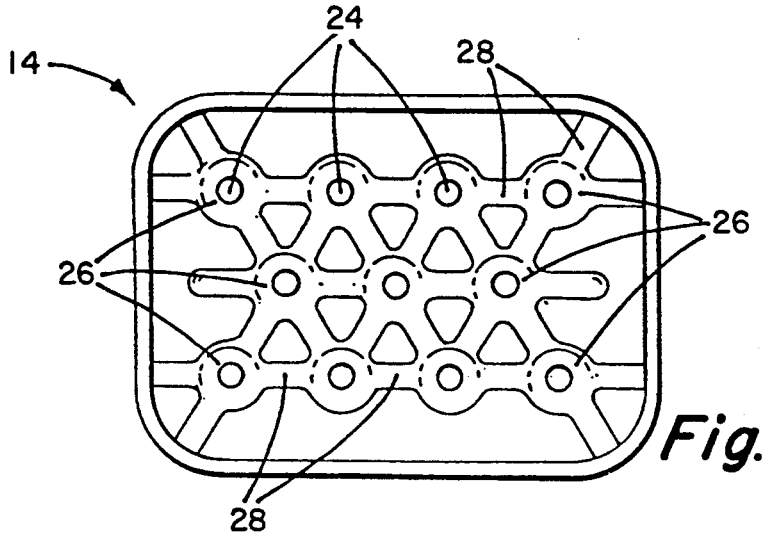
FIG. 3 is a bottom plan view of the padding module 14 of FIG. 2.

In a preferred embodiment, the lower surface of each module 14 is provided with a plurality of channels interconnecting air passages 24 to allow more complete ventilation and cooling of the skin. One acceptable configuration of this feature is shown in FIG. 3. Each air passage 24 opens into a recessed chamber 26 in the lower surface of module 14 facing the skin. Each chamber 26 is placed in communication with at least one other chamber 26 of an adjacent air passage 24 by means of a channel 28. Typically, a plurality of channels 28 interconnect each chamber 26 with a like number of adjacent chambers 26 of associated air passages 24. In this manner, as module 14 is placed adjacent the skin, channels 28 and chambers 26 cooperate to provide gaseous communication between air passages 24 and large portions of the skin surface to allow heat and perspiration to be vented from the skin through air passages 24. In an alternative embodiment, channels 28 may be formed as parallel, closely spaced undulations in the undersurface of module 14 and may extend to and through a plurality of aligned chambers 26 to interconnect a plurality of air passages 24.

As shown in FIG. 3, channels 28 preferably extend to the edges of each module 14, whether channels 28 cross one another or are aligned in a parallel relationship. When so configured, channels 28 also serve as pathways which collect and drain perspiration from under modules 14.

In a preferred embodiment, as shown in FIG. 1, membrane 16 is formed separately of modules 14, and is secured thereto after formation. Typically, membrane 16 is stitched to modules 14, as shown in FIG. 1, along necked down or narrowed portions 15 of modules 14 formed on a perimeter of modules 14. The use of stitching adds flexibility and strength during movement, and modules 14 and membranes 16 can be made of different colors or designs. In an alternate embodiment (not shown), upper layer 12 of module 14 can be co-extensive with upper layer 18 of membrane 16, while lower layer 17 may be co-extensive with lower layer 20 of membrane 16. In this embodiment, modules 14 and membranes 16 are formed at the same time, and layers 12 and 17 are drawn tightly around the edges of modules 14 and become layers 18 and 20 of membrane 16. In this embodiment, layer 22 of membrane 16 may be formed of the same material as material 11 of module 14, except that layer 22 would be thinner than layer 11.

Modules 14 typically are formed of a molded foam material. In a preferred embodiment, modules 14 are formed of a closed cell foam. Typical polymers include cross-linked polyethylene, a polyurethane polymer, polyvinyl chloride, polypropylene, styrene or polyester. Preferred materials are cross-linked polyethylene and/or polyurethane. Additives such as EVA (ethylenevinylacetate) can be added to the polyethylene during the cross-linking process. Chemical and irradiative cross-linking can be used according to methods known to those of ordinary skill in the art.

Intermodular membrane 16 often provides most of the surface area of body padding 10. Typically, layer 22 of intermodular membrane 16 is formed of either an open cell or a closed cell foam. An open cell foam would be used if it is desired to enhance the breathability of the padding, while a closed cell foam would be used if it was desired to reduce the breathability of the padding. In one embodiment, layer 22 is formed of a perforated, closed cell neoprene sheet which is typically about 1.0 mm to about 1.5 mm in thickness. In another embodiment, layers 18 and 20 may be bonded directly together to form membrane 16, eliminating layer 22 entirely.

Layers 18 and 20 are formed of an elastic or stretch fabric. Preferably, layers 12 and 17 and layers 18 and 20 are breathable, although they need not all be breathable. In some embodiments, only layers 17 and 20 are breathable, while in other embodiments, none of layers 12, 17, 18 or 20 is breathable. If breathable materials are used for layers 18 and 20, typically layer 22 is breathable as well. Such a breathable layer 22 would be formed of either an open cell foam or some other nonbreathable material provided with multiple air passages. In a preferred embodiment, lower layers 17 and 20 are formed of a cotton-lycra blend, or a breathable fabric such as Cool Max®. Typically, upper layers 12 and 18 are formed of a nylon stretch fabric in an open weave. In another embodiment, upper layer 12 may be formed of a molded felt, particularly when padding 10 is used for sports which utilize hardwood floors such as volleyball, basketball and ballet.

Upper layer 12 and lower layer 17 may be secured to material 11 within module 14 in any conventional manner. Suggested means of attachment include gluing or mechanical means such as stitching or sewing. In a preferred embodiment, layers 12 and 17 are heat and pressure bonded to material 11 of module 14 in a manner well known to those skilled in the art.

Figure 7:
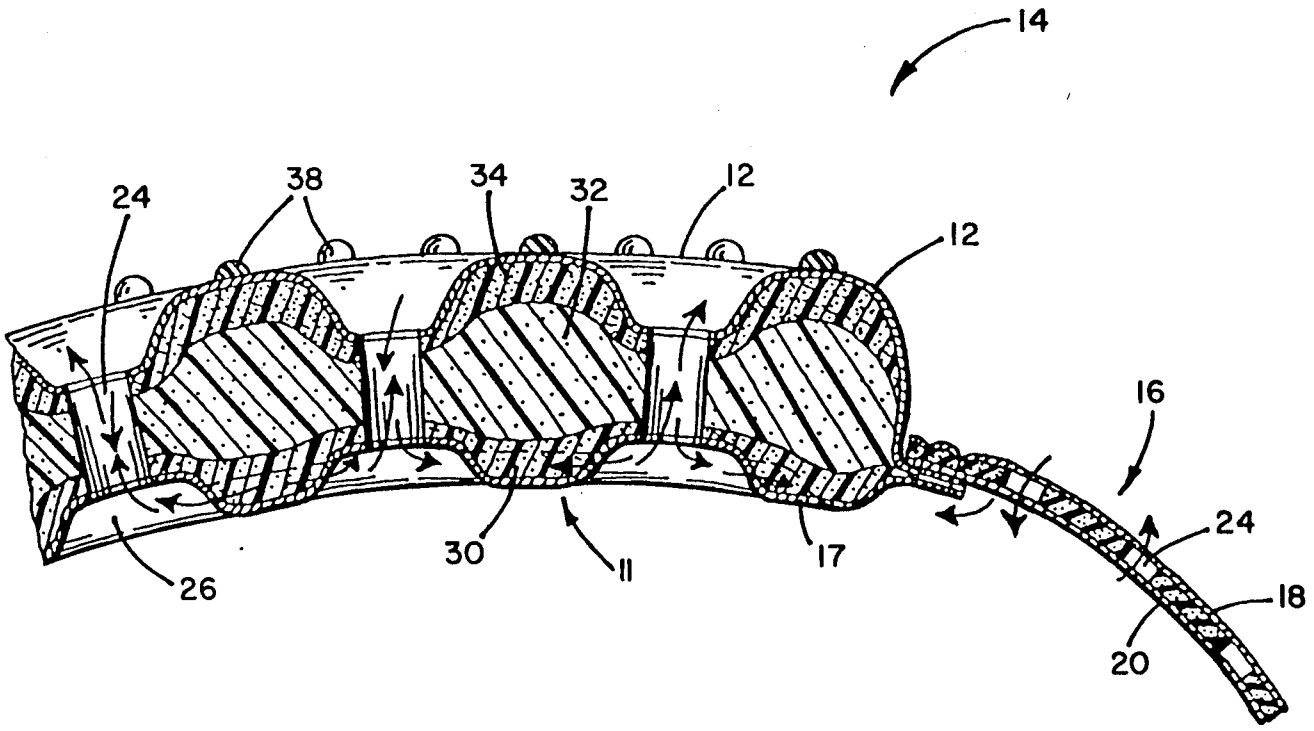
FIG. 7 is a cross-sectional view of another embodiment the body padding of this invention.
Figure 8:
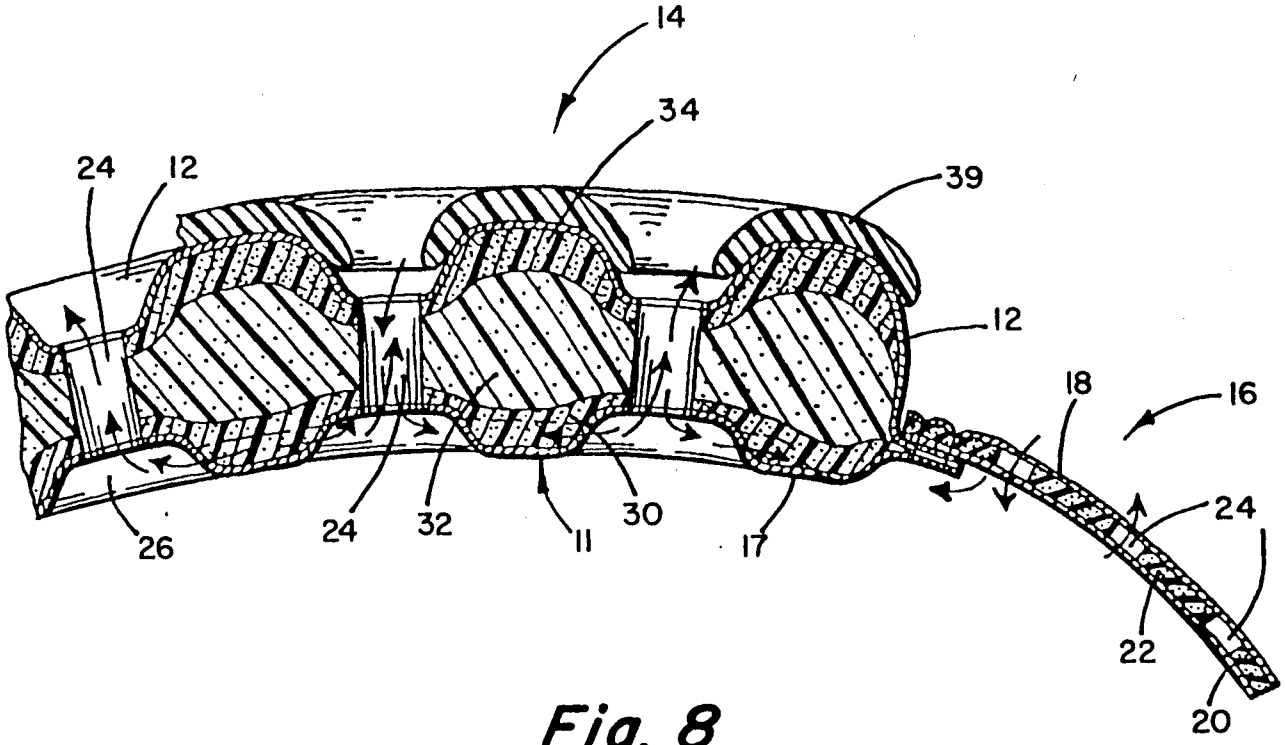
FIG. 8 is cross-sectional view of another embodiment of the body padding of this invention.

In a preferred embodiment, modules 14 are formed with a variable density such that the density of material 11 increases in a direction away from the surface of the body, or away from lower layer 17. This structure is created using a plurality of distinct foam layers. Typically, module 14 has a tripartite density distribution, comprising layers 30, 32 and 34, as shown in FIGS. 7 and 8. The structure of FIGS. 7 and 8 is similar to that of FIG. 1, and like numbers are used for like parts, where possible. A layer 30 of a low density foam comprises the bottom portion of module 14. Layer 30 may be formed of a polyethylene cross-linked foam or an open cell flexible urethane foam and typically has a density of about 4–6 pounds per cubic foot. Central layer 32 is preferably a medium density cross-linked polyethylene foam, having a density of about 3 pounds per cubic foot. Layer 34 is formed of a high density foam and is the uppermost layer of module 14 closest to upper layer 12. Layer 34 typically is formed of a cross-linked closed-cell polyethylene foam, and typically has a density of about 6–11 pounds per cubic foot. In operation, layer 34 distributes a point impact to a larger area of padding 10, layer 32 cushions the blow and layer 30 both cushions and conforms to the body. Also, layer 30, being an open cell foam, helps enhance the breathability of the padding, as it permits some lateral gaseous communication between air passages 24 and the skin under layer 30.

The length and thickness of modules 14 can vary depending on the activity they are designed to protect. Preferably, the thicker regions of modules 14 are approximately 1 cm to about 3 cm thick. When a three layer construction is used, as shown in FIG. 7, in an exemplary embodiment, layer 30 is between about 0.318" to 0.635 cm thick, layer 32 is between about 0.476 cm to 0.635 cm thick and layer 34 is between about 0.318 cm to 0.635 cm thick.

Upper layer 12 of each module 14 may remain exposed as shown in FIG. 1, or it may be covered in some manner. A covering serves one or more of three different purposes. The first purpose is to provide a hard surface for wear resistance and to protect upper layer 12 of module 14. Another purpose is to provide each module 14 with a nongripping material on the surface thereof, so that modules 14, and thus padding 10, will slide upon any playing surface or other surface upon which it impacts to minimize frictional engagement between padding 10 and such a surface which would cause padding 10 to be pulled from the body or to be moved from its desired position on the body. A third purpose is to permit the use of reflective material to increase nighttime visibility.

Figure 9:
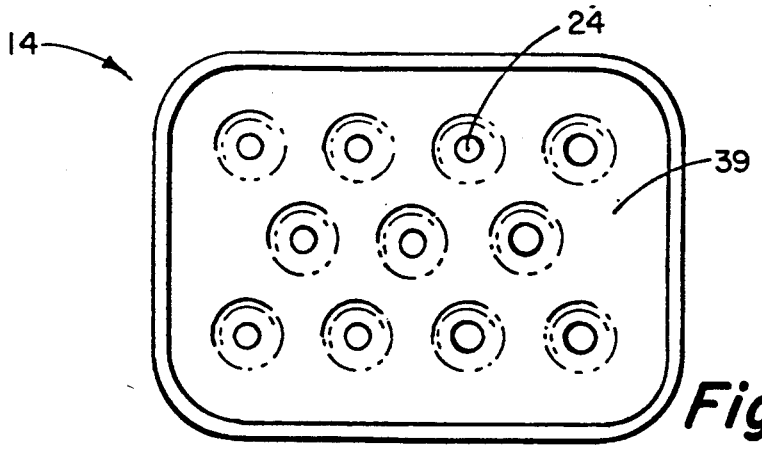
FIG. 9 is a top plan view of the body padding of FIG. 8.

In one embodiment, as shown in FIGS. 8 and 9, where parts similar to those in FIG. 1 have like numbers, upper layer 12 is covered by a cap 39 formed of rigid plastic. Cap 39 conforms to the upper surface of module 14, and includes openings formed therein overlying the upper termini of each of air passages 24 to permit the free flow of air through air passages 24. Cap 39 typically is formed of a high density polyethylene or ABS or other like plastic. In forming cap 39, once layer 12 is bonded onto material 11, molten plastic or resin is allowed to flow onto fabric 12, and thus the molten plastic or resin seeps between the fibers of layer 12 and hardens. The plastic can be applied in various patterns for graphic effect and provides a hard surface for wear resistance.

Figure 2:
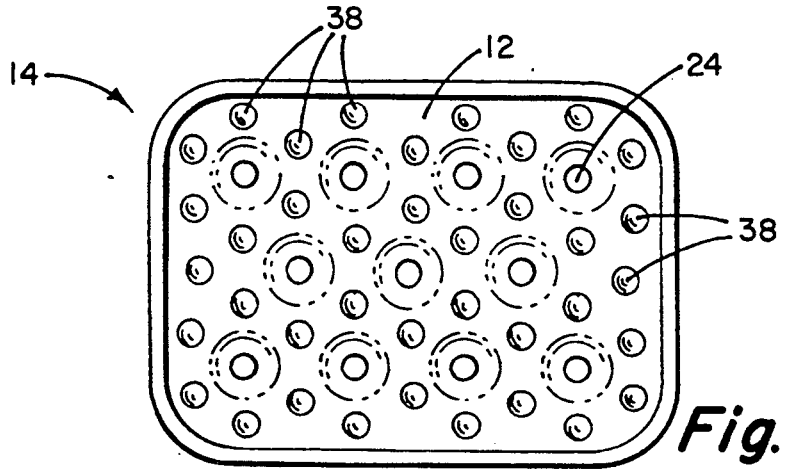
FIG. 2 is a top plan view of a padding module of this invention.

Another embodiment of module 14 is shown in FIGS. 2 and 7. In this embodiment, the surface of upper layer 12 is covered with a plurality of somewhat hard, impact resistant nodules or droplets 38 which are affixed thereto at positions designed not to interfere with the passage of air through air passages 24. Droplets 38 preferably are formed of plastic and may contain reflective material to permit padding 10 to be worn at night.

Figure 4:
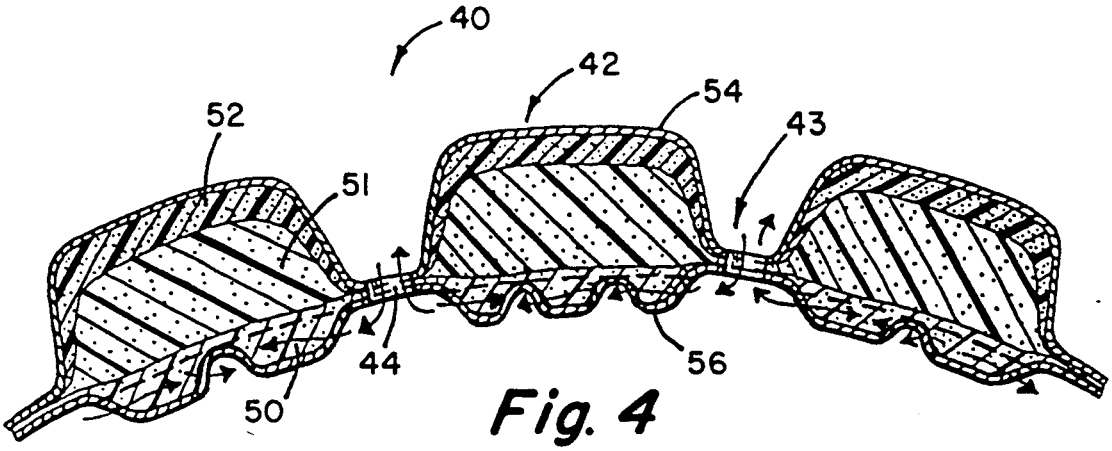
FIG. 4 is a cross-sectional view of another embodiment of the padding of this invention.
Figure 5:
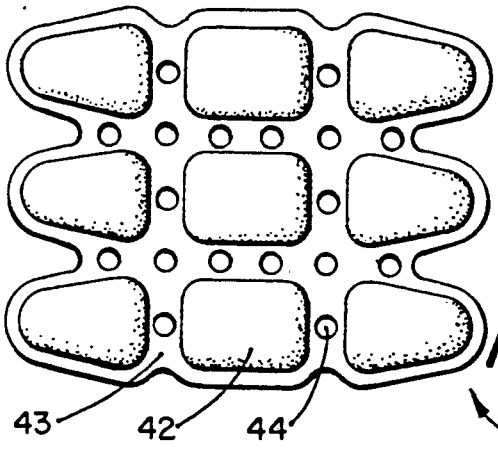
FIG. 5 is a top plan view of the padding module of FIG. 4.

Another embodiment of the padding of this invention will now be described with particular reference to FIGS. 4–6. In this embodiment, as in FIG. 1, padding 40 comprises a series of modules 42 interconnected by intermodular membranes 43. While three layers 50, 51 and 52 of foam are illustrated in FIG. 4, it is to be understood that this embodiment could be used with one, two or three or more layers of different foam. In this embodiment in contrast to prior embodiments, no air passages are provided through modules 42. Air passages 44 extend only through the intermodular membranes 43, as shown in FIGS. 4 and 5. In this embodiment, typically padding 40 is formed as a unitary body so that one or two of layers 50, 51 or 52 extends into membrane 43 and forms the central layer thereof. Upper layer 54 and lower layer 56 extend over both modules 42 and membrane 43 and are bonded to layers 50, 51 and 52 to capture them therebetween to form modules 42 and membranes 43. Alternatively, membranes 43 and modules 42 may be separately formed and stitched together.

Figure 6:
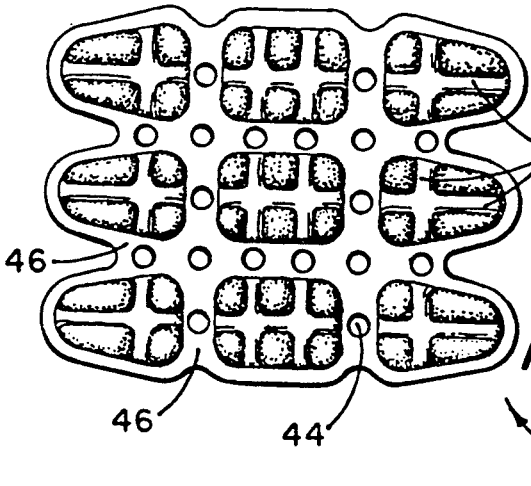
FIG. 6 is a bottom plan view of the padding module of FIG. 4.

As in previous embodiments, channels are provided on the lower surface of padding 40 to facilitate gaseous communication between the skin surface and air passages 44 to permit the escape of heat and moisture, as shown in FIG. 6. One set of channels 46 is formed beneath intermodular membrane 43 to interconnect the lower termini of air passages 44. Typically channels 46 are formed by spacing membrane 43 from the skin surface by locating membrane 43 at a position spaced from the lower surface of modules 42, but generally parallel thereto. Channels 46 are defined by the skin surface, membranes 43 and the lateral surfaces of modules 42, when padding 40 is applied to the body. A second set of channels includes a plurality of channels 48 which crisscrosses each module 42. Channels 48 communicate with channels 46 disposed beneath intermodular membrane 43 and thus with air passages 44. The embodiment of FIGS. 4 through 6 provides enhanced air flow adjacent the skin surface, and thus enhanced removal of heat and moisture therefrom.

Figure 10:
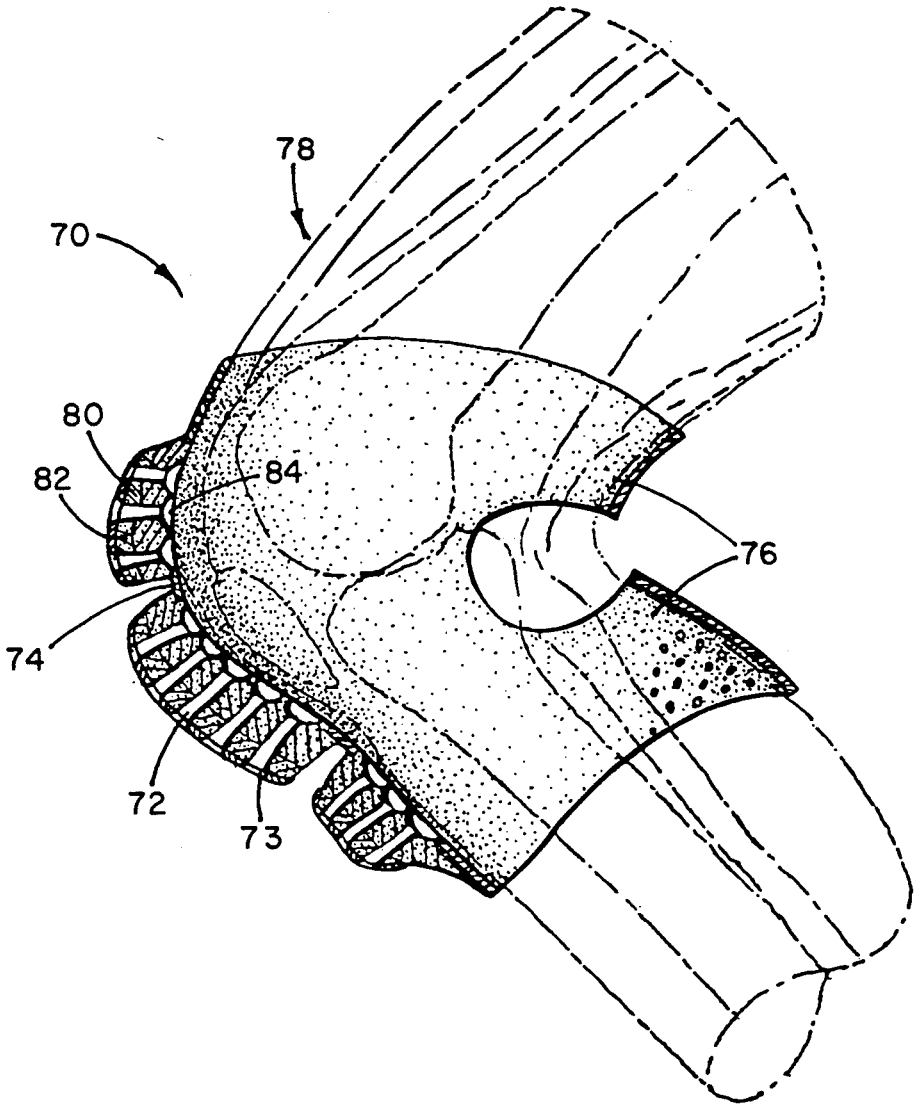
FIG. 10 is a side view of a flexed human knee showing the body padding of this invention in cross section.

The padding modules and the intermodular membrane of this invention may be arranged in any configuration to provide for specific protection to vulnerable areas, and to provide the articulation required by a particular body part. For example, a knee guard 70 is shown in FIG. 10 and comprises modules 72 interconnected by membrane 74. A further elastic membrane 76 surrounds the knee joint 78 and retains guard 70 in place on knee joint 78. Membranes 74 and 76 may be formed of the same material, or membrane 76 may be formed of a different, higher power elastic material than membrane 74. Each module 72 comprises a layer 80 of foam sandwiched between upper 82 and lower 84 resilient layers, as described above. When the joint is flexed, articulation of guard 70 is permitted by membrane 74 to permit guard 70 to conform to movements of joint 78 and to cause modules 72 to be in the proper position to receive an impact. Air passages 73 allow venting of heat and moisture from the skin as described.

Figure 11:
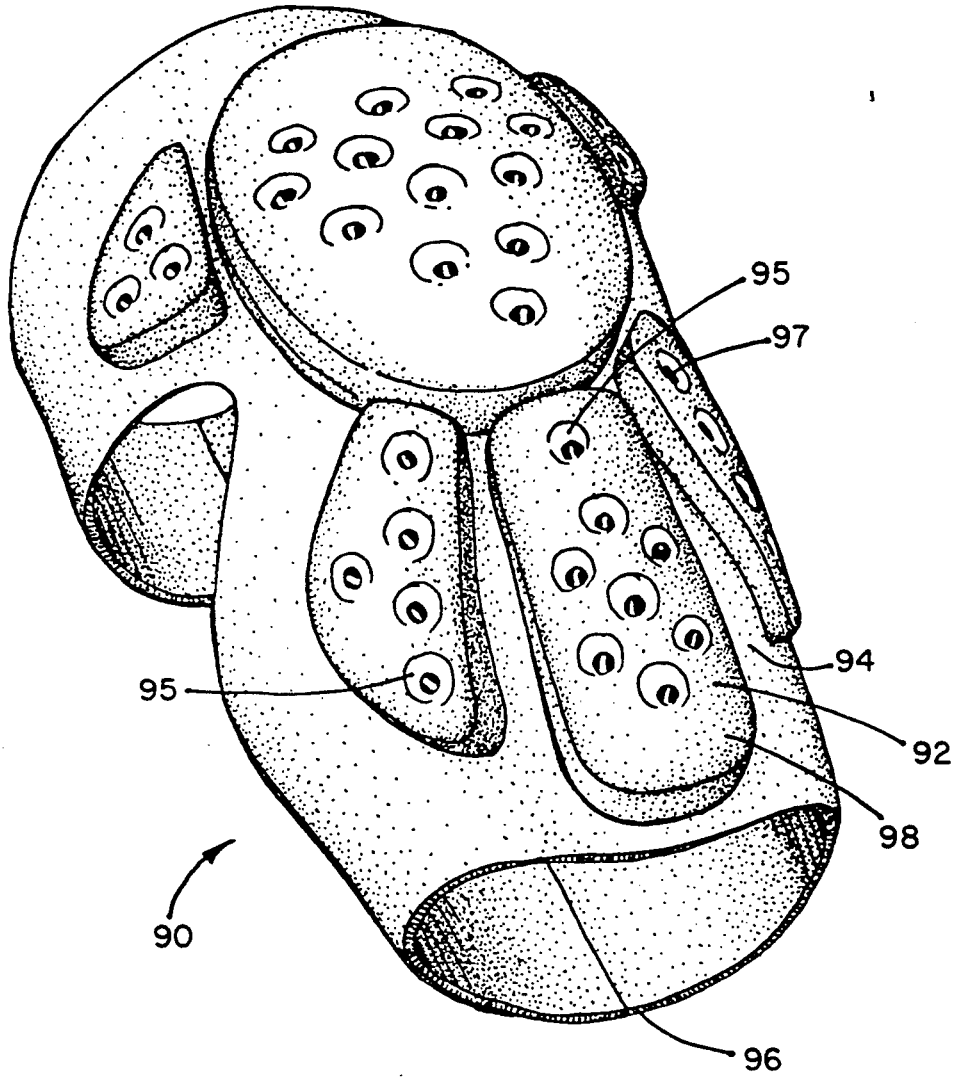
FIG. 11 is a perspective view of another embodiment of a knee guard utilizing this invention.

FIG. 11 shows a perspective view of another embodiment of a knee guard 90 of this invention. Knee guard 90 has a plurality of modules 92 dispersed within intermodular membrane 94, and membrane 96 surrounds the knee. In this embodiment, a rigid plastic cap 98 covers the upper surface of modules 92. Breathability is provided by air passages 97 which pass through modules 92, and which have upper termini communicating with recessed depressions 95 in cap 98. Air passages 95 may also be provided in membrane 96 to improve breathability.

Figure 12:
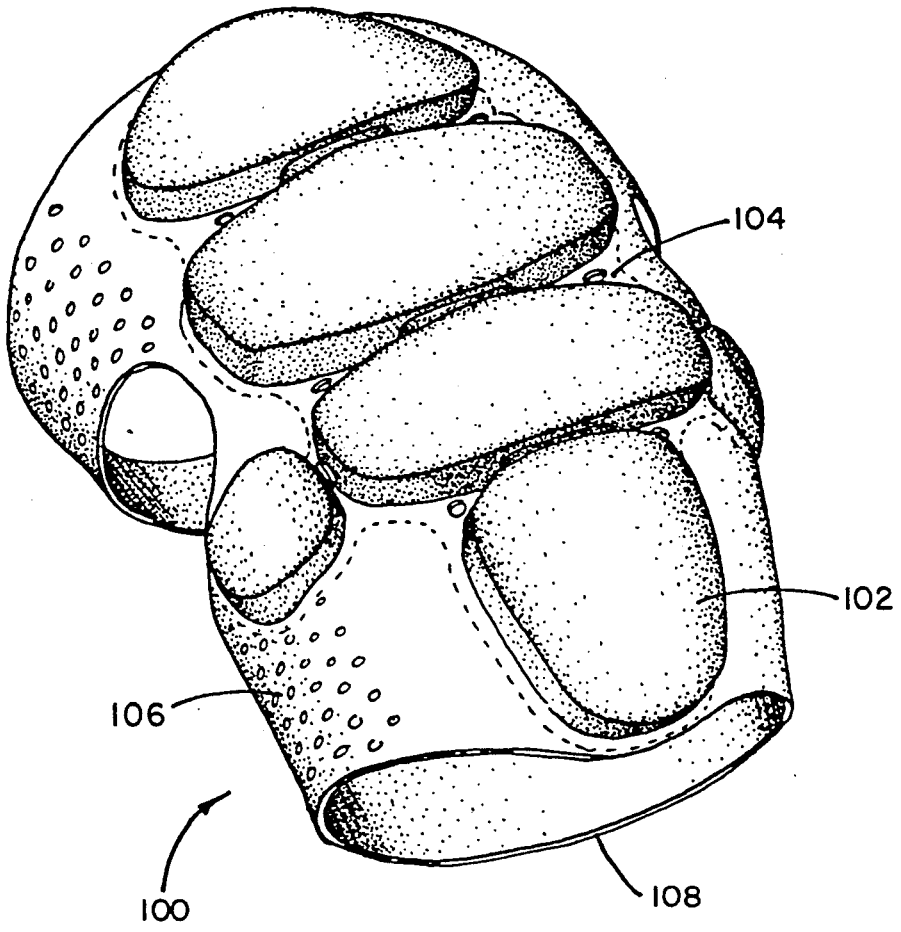
FIG. 12 is a perspective view of yet another embodiment of a knee guard utilizing this invention.

Another embodiment of a knee guard 100 is shown in FIG. 12. Knee guard 100 includes modules 102 separated by intermodular membranes 104, which membranes contain a plurality of air passages 106. Membrane 108 surrounds the knee and contains air passages 106. No air passages are provided in modules 102.

Figure 13:
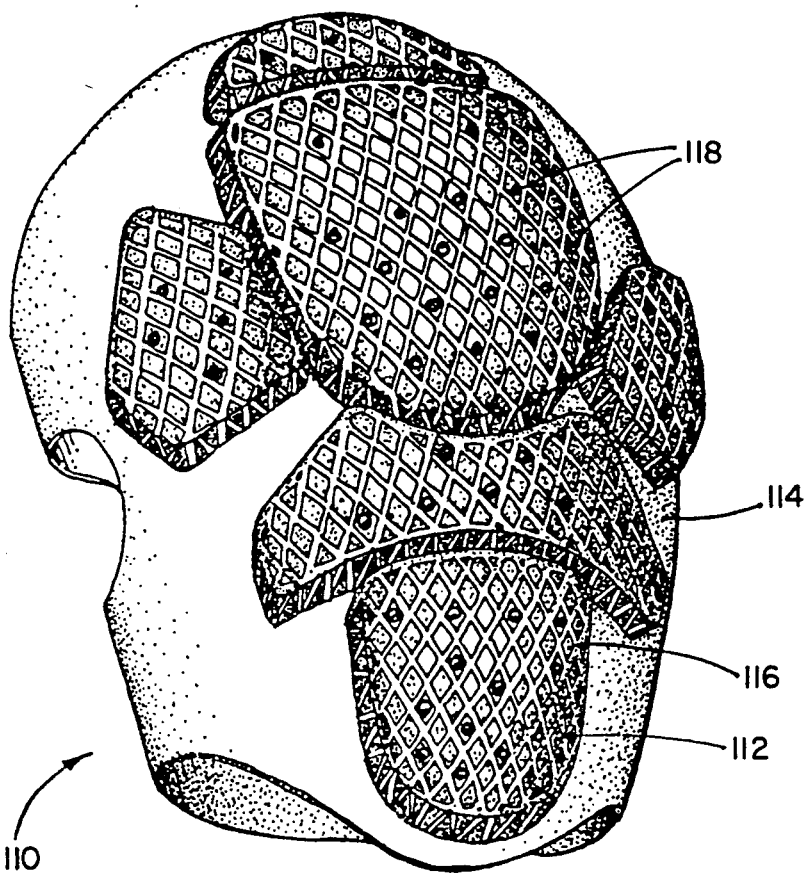
FIG. 13 is yet another embodiment of a knee guard utilizing this invention.

FIG. 13 illustrates a knee guard 110 having modules 112 and membrane 114. Modules 112 are covered by an upper layer 116 of an open mesh construction. Preferably, layer 116 is sufficiently flexible to conform to the three-dimensional shape of modules 112. Layer 116 can be made of high-carbon fiber mesh or stretch nylon mesh material such as Cordura® nylon. Air passages 118 extend through modules 112 and communicate with the environment through openings in layer 112.

Figure 14:
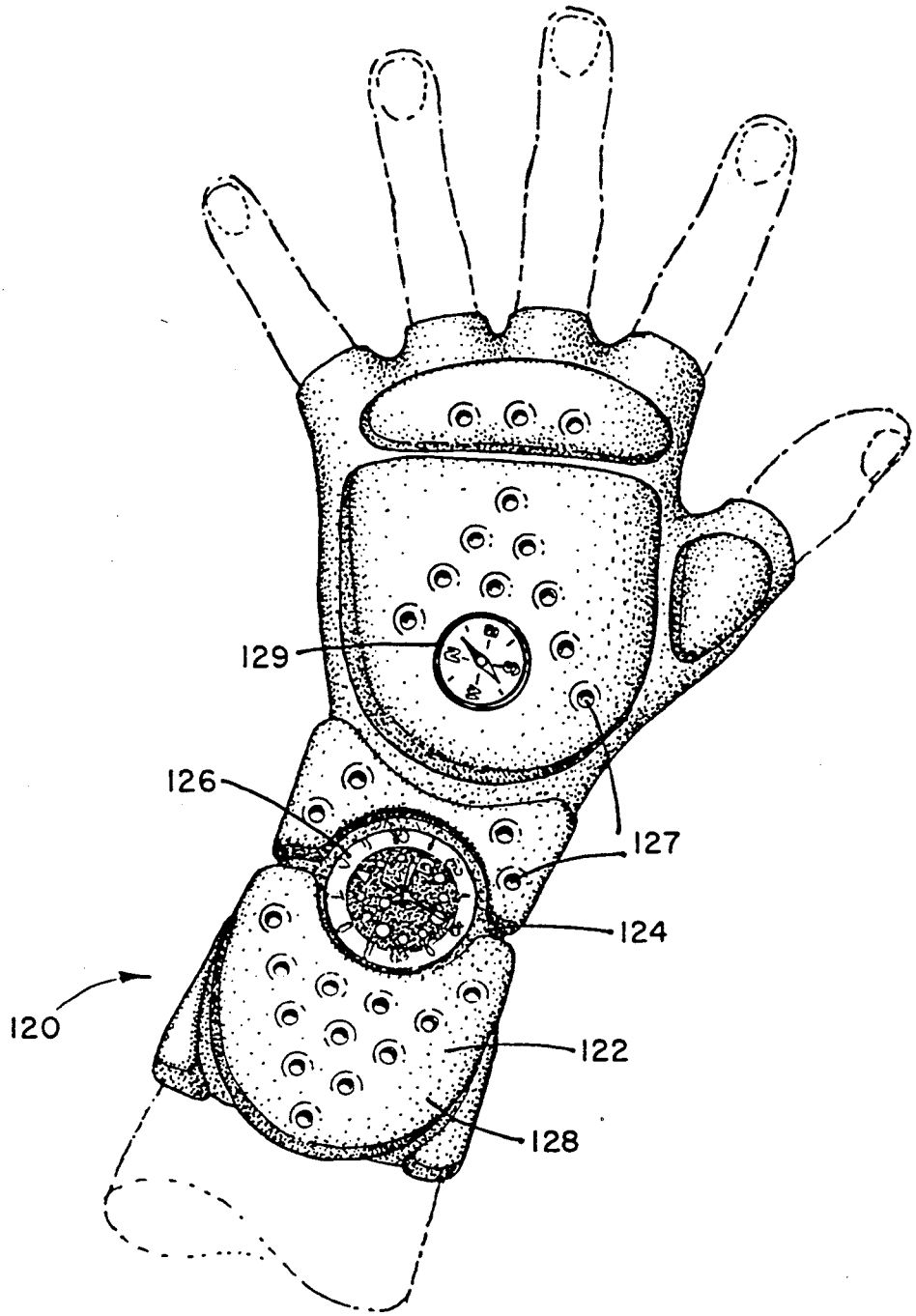
FIG. 14 is a top plan view of a wrist and hand guard utilizing the padding of this invention.

To protect the wrist, a wrist guard 120 may be fabricated as shown in FIG. 14. Wrist guard 120 is designed to slip over the hand and onto the wrist, and is comprised of modules 122 with relatively small intermodular membrane 124. A watch or other time keeping device 126 and/or a compass 129 can be integrated into the upper surface of the protective wrist guard 120. This embodiment also illustrates rigid cap 128 which is affixed to the upper surfaces of modules 122 and which is designed to provide abrasion resistance. Air passages 127 pass through modules 122 and cap 128. Cap 128 is not necessary and can be eliminated, as can device 126 and compass 129.

Figure 15:
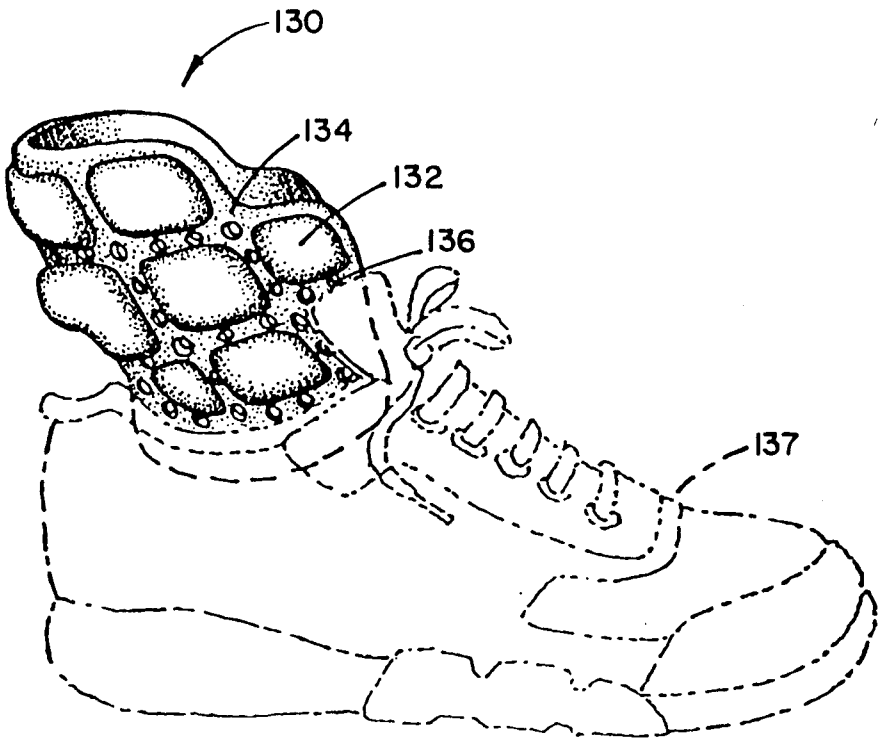
FIG. 15 is a perspective view of an ankle guard utilizing the padding of this invention.

FIG. 15 illustrates one embodiment of an ankle padding 130 of the invention having modules 132, membrane 134 and air passages 136. Membrane 134 is formed on tapered sections extending between adjacent foam modules 132. Membrane 134 and modules 132 may have a structure like that of any one of the structures described in FIGS. 1–9 and the accompanying text. Padding 130 may be attached to the upper opening of a shoe 137 as shown.

Figure 16:
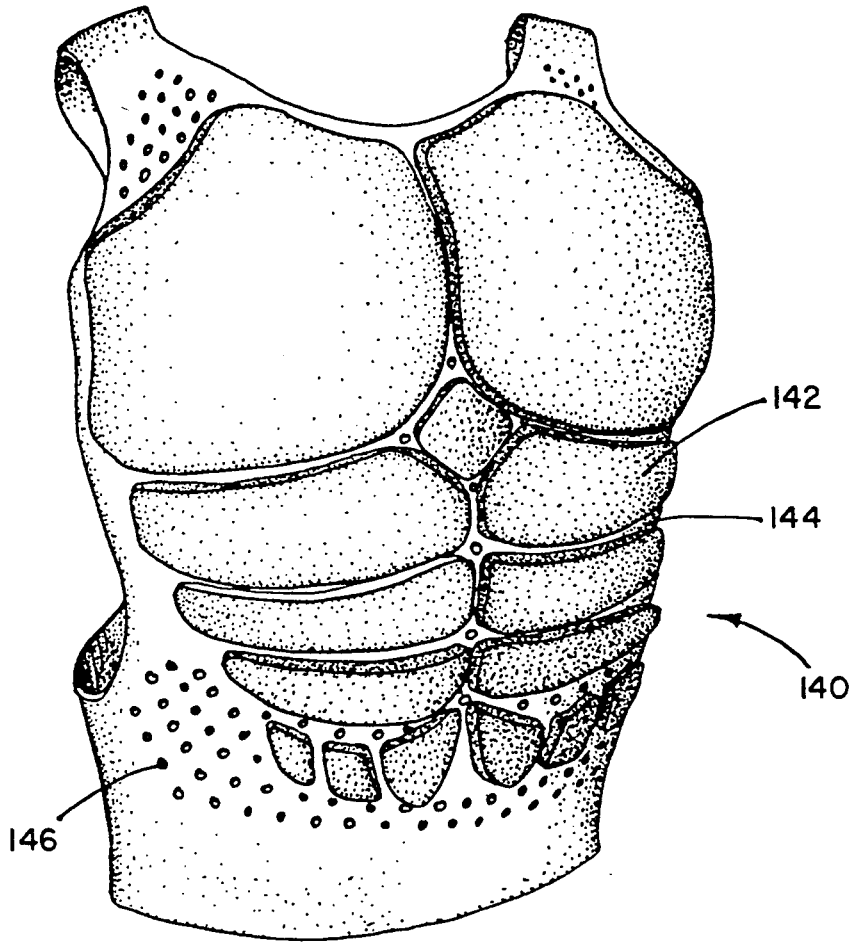
FIG. 16 is a perspective view of a chest protector utilizing this invention designed primarily for body surfing.

The outer surface of the padding of this invention can be covered with patterns or fabrics or embossed forms to enhance the aesthetic and fashion expression thereof. For example, the padding can be displayed in different colors and in different configurations to simulate various desired objects or body features. FIG. 16 illustrates an embodiment of a vest 140 for use in bodysurfing. Vest 140 includes modules 142 interconnected by membrane 144 having air passages 146. Modules 142 are configured to simulate a body builder's muscles. Modules 142 add buoyancy, which provides an added safety feature, as well as improves the performance for body surfers. Modules 142 and membrane 144 may have a structure like that of any one of the structures described in FIGS. 1–9, and the accompanying text. The identity of manufacturer's brand names and the like can be easily embossed or graphically displayed on vest 140.

Figure 17:
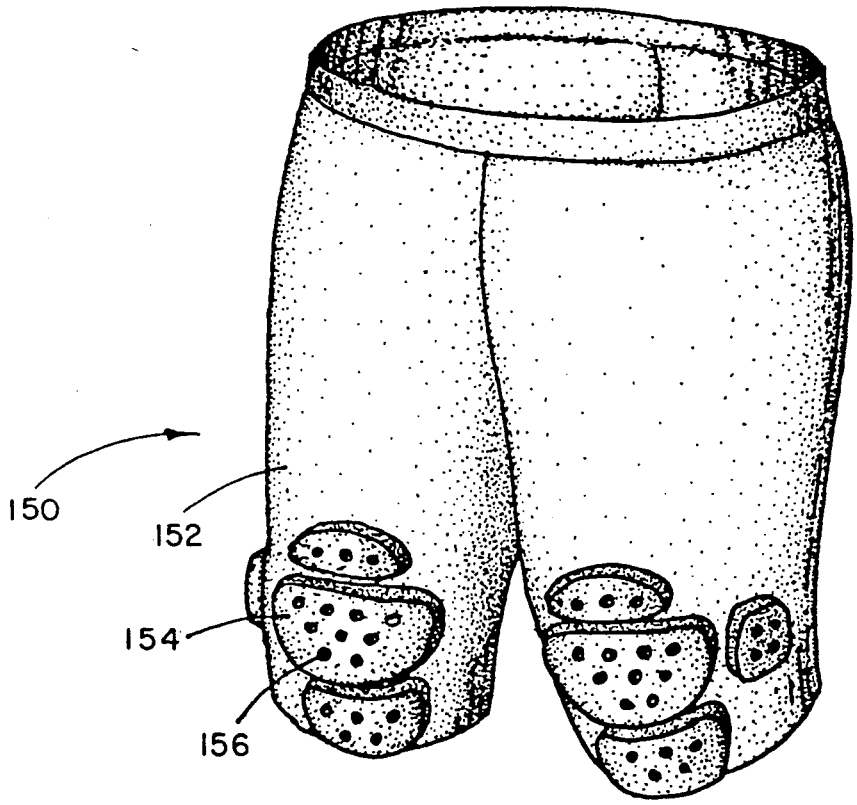
FIG. 17 is a perspective view of an item of clothing incorporating the padding of this invention.

The body padding of this invention also can be incorporated into items of clothing which are worn on the body. An example of such clothing is shown in FIG. 17 which illustrates the use of this invention in conjunction with a pair of stretch pants 150. Pants 150 include modules 154 located at strategic points on the surface of membrane 152 which forms the material of pants 150. Modules 154 are stitched to membrane 152, or are captured between layers of membrane 152. Portions of membrane 152 are disposed between each module 154 and connect the modules. Preferably, each module 154 is provided with a plurality of air passages 156. Modules 154 each may have any one of the structures of the modules described in FIGS. 1–9 and the accompanying text. Pants 150 can be similar to any conventional stretch pants used for bicycling or running which are well known in the art. A typical material used to form pants 150 and thus membrane 152 is lycra. The concept of FIG. 17 can be applied equally to shirts, longer pants and other types of clothing.

The padding of this invention can be configured in any shape and be provided in any color or design desirable. The padding can be made to conform to current fashion demands, thus rendering it fashionable to young people who would otherwise not want to wear protective body padding.

The body padding of this invention can be configured to protect a multitude of body parts such as knees, ankles, wrists, elbows, chests, shoulders, backs, hips, heads and shins. Body padding can be worn in a wide variety of activities including, but not limited to: baseball, basketball, football, volleyball, ice hockey, field hockey, soccer, lacrosse, tennis, racquetball, handball, squash, wrestling, rugby, on-road and off-road biking, roller blading, roller skating, skateboarding, windsurfing, and surfing.

In view of the above description, it is likely that modifications and improvements will occur to those in the art which are within the scope of this invention. The above description is intended to be exemplary only, the scope of the invention being defined by the following claims and their equivalents.

What is claimed is:

1. Articulated body padding comprising:

a plurality of modules, each of said modules having an upper surface and a lower surface, said lower surface being adapted to be adjacent to a surface of a body;

an elastic membrane interconnecting said modules, said membrane having an upper surface and a lower surface, said membrane being directly secured to at least some of said modules; and a plurality of air passages, said air passages extending from and through said upper surface to and through said lower surface of at least a selected one of said modules and said membrane to provide direct gaseous communication between the surface of the body and an environment surrounding the body.

2. The padding of claim 1 wherein said modules are formed of a molded foam material.

3. The padding of claim 2 wherein each of said modules comprises a plurality of layers of foam, each of said layers of foam having a different density.

4. The padding of claim 3 wherein said modules comprises a lower layer of foam which is formed of an open cell foam, and wherein said module comprises an upper layer of foam formed of a closed cell foam.

5. The padding of claim 3 wherein the density of one of said layers of foam adjacent said upper module surface is greater than the density of a layer of foam adjacent said lower module surface.

6. The padding of claim 6 further comprising hardened protective means directly bonded to said upper surface of each of said modules.

7. The padding of claim 6 wherein said hardened protective means comprises a plurality of nodules.

8. The padding of claim 6 wherein said hardened protective means comprises a layer of a hardened plastic material directly bonded to said upper surface of said module.

9. The padding of claim 1 wherein said modules and said membrane are formed independently of one another and are coupled after formation thereof.

10. The padding of claim 1 wherein said modules and said membrane are formed as a unitary structure.

11. The padding of claim 1 wherein said membrane is formed on connecting peripheral portions of said modules.

12. The padding of claim 11 wherein said air passages are disposed only in said membrane.

13. The padding of claim 1 wherein said air passages are disposed only in said modules.

14. The padding of claim 1 wherein said air passages are disposed only in said membrane.

15. The padding of claim 1 wherein said membrane includes an extended portion adapted to be wrapped about a body part to secure said body padding to a body part.

16. The padding of claim 1 wherein each of said modules comprises a layer of foam disposed between two layers of stretch fabric.

17. The padding of claim 1 wherein said air passages are disposed in both said modules and said membrane.

18. The articulated body padding of claim 1 further comprising air communication means disposed on said lower surface of said selected one of said modules and said membrane, said air communication means interconnecting said air passages.

19. Body padding comprising upper and lower layers of stretchable, breathable fabric, said lower layer of fabric being adapted to be adjacent a surface of a body, said fabric layers having sandwiched between them a plurality of foam modules, each of said foam modules having an upper surface and a lower surface, said foam modules being spaced from one another in a direction generally parallel to the surface of the body, said body padding comprising a plurality of air passages extending from and through said upper layer to and through said lower layer to provide direct gaseous communication between an environment surrounding the body and the surface of the body.

20. The padding of claim 19, wherein said air passages extending through said foam modules.

21. Body padding comprising upper and lower layers of stretchable, breathable fabric, said lower layer of fabric being adapted to be adjacent a body, said fabric layers having sandwiched between them a plurality of spaced, foam modules having an upper surface and a lower surface, said body padding comprising a plurality of air passages extending from said upper layer to said lower layer, wherein each of said foam modules includes a tapered periphery and wherein said air passages extend through said tapered periphery of said foam modules.

22. Body padding comprising upper and lower layers of stretchable, breathable fabric, said lower layer of fabric being adapted to be adjacent a body, said fabric layers having sandwiched between them a plurality of spaced, foam modules having an upper surface and a lower surface, said body padding comprising a plurality of air passages extending from said upper layer to said lower layer, said body padding further comprising a plurality of air channels interconnecting lower termini of said air passages, said air channels being substantially parallel with said lower layer of fabric.

23. Body padding comprising upper and lower layers of stretchable, breathable fabric, said lower layer of fabric being adapted to be adjacent a body, said fabric layers having sandwiched between them a plurality of spaced, foam modules having an upper surface and a lower surface, said body padding comprising a plurality of air passages extending from said upper layer to said lower layer, wherein said foam modules have variable density, the density thereof increasing in a direction away from said lower layer toward said upper layer.

24. Articulated body padding comprising:

a plurality of modules, each of said modules having an upper surface and a lower surface;

an elastic membrane interconnecting each of said modules, said membrane having an upper surface and a lower surface, said membrane comprising a layer of foam disposed between two layers of stretch fabric; and a plurality of air passages, said air passages extending from said upper surface to said lower surface of at least a selected one of said modules and said membrane.

25. Body padding comprising upper and lower layers of resilient, breathable fabric, said lower layer of fabric being adapted to be adjacent a body, said fabric layers having sandwiched between them a plurality of spaced, foam modules having an upper surface and a lower surface, said body padding comprising a plurality of air passages extending from said upper layer to said lower layer and means for providing air distribution between said air passages along said lower layer.

26. Body padding comprising upper and lower layers of resilient, breathable fabric, said lower layer of fabric being adapted to be adjacent a body, said fabric layers having sandwiched between them a plurality of spaced, foam modules having an upper surface and a lower surface, said foam modules having a variable, tripartite density distribution, the density thereof increasing in a direction away from said lower layer toward said upper layer, said body padding comprising a plurality of air passages extending from said upper layer to said lower layer.

27. The padding of claim 26, wherein the modules comprise a layer of a low density open cell foam adjacent said lower layer, and a layer of high density, closed cell foam adjacent said upper layer.

28. Articulated body padding comprising:

a plurality of foam modules each having an upper surface and a lower surface;

a first membrane having an upper surface and a lower surface and interconnecting adjacent ones of said modules, said modules being rigid relative to said first membrane, said first membrane being sufficiently flexible to allow bending thereof in response to movement of a body part;

a second, elastic membrane having an upper surface and a lower surface, said second membrane being secured to at least some of said modules and being adapted to extend around a body part to capture the body part between said lower surface of said second membrane and said lower surfaces of said modules to retain said modules in a desired position on the body part, said second, elastic membrane comprising a layer of foam disposed between two layers of stretch fabric; and a plurality of air passages, said air passages extending between said upper surface and said lower surface of at least a selected one of said modules, said first membrane and said second membrane.

29. The articulated body padding of claim 28 further comprising air communication means disposed on said lower surface of said selected one of said modules, said first membrane and said second membrane, said air communication means interconnecting said air passages.

* * * * *